United States Patent [19]

Justice et al.

[11] 4,082,362

[45] Apr. 4, 1978

[54] APPARATUS FOR COAL MINING IN-CUTTING AND OUT-CUTTING

[75] Inventors: James Conley Justice; Frank A. Delli-Gatti, Jr., both of Beckley, W. Va.

[73] Assignee: Coaltex, Inc., Beckley, W. Va.

[21] Appl. No.: 760,422

[22] Filed: Jan. 18, 1977

Related U.S. Application Data

[63] Continuation-in-part of Ser. No. 649,579, Jan. 16, 1976, Pat. No. 4,003,602.

[51] Int. Cl.[2] ..... E21C 27/22

[52] U.S. Cl. ..... 299/57; 175/91; 299/18; 299/67; 299/80

[58] Field of Search ..... 299/18, 55-57, 299/64, 59, 80, 67; 175/53, 91

[56] References Cited

U.S. PATENT DOCUMENTS

| | | | |
|---|---|---|---|
| 3,280,416 | 10/1966 | Forsyth | 175/53 X |
| 3,333,898 | 8/1967 | Russell | 299/18 X |
| 3,642,325 | 2/1972 | Mulvaney | 299/18 |
| 4,003,602 | 1/1977 | Justice et al. | 299/18 |

FOREIGN PATENT DOCUMENTS

| | | | |
|---|---|---|---|
| 193,407 | 5/1967 | U.S.S.R. | 299/80 |
| 274,047 | 6/1970 | U.S.S.R. | 299/56 |
| 314,891 | 9/1971 | U.S.S.R. | 299/80 |
| 308,187 | 7/1971 | U.S.S.R. | 299/80 |

*Primary Examiner*—Ernest R. Purser
*Attorney, Agent, or Firm*—Cushman, Darby & Cushman

[57] ABSTRACT

Apparatus for forming bores and coal seams and the like and enlarging preexisting bores. A mining machine includes a nonrotatable body member, a conveyor in line with the body member, a pilot head, and a pair of wing cutters mounted to the body member for pivotal movement with respect to the body member. Structure is provided for moving coal or the like cut by the wing cutters during out-cutting toward the sides of the bore, the structure including a pair of shields, one associated with each wing cutter and disposed between the wing cutter and the body member and pilot head, and a generally conical member coaxial with the shaft for rotation of the pilot head. Stabilization of the body member, etc., within the bore is provided by a pair of wheel sets spaced along the length of the conveyor, and a pair of right angle guide members vertically displaced from the wheel structure of one the wheel sets. The back set of wheels may include a pair of vertically spaced wheels on each side of the conveyor, one wheel of each set engaging the roof of the bore while the other wheel engages the floor, and the roof engaging wheel and floor engaging wheel may both be vertically adjustable. A roof cutter may also be provided including a cutting drum rotatable about a horizontal axis and a pair of chain cutters rotating the cutting drum and connected to a horizontal shaft that is stationary with respect to the body member.

21 Claims, 15 Drawing Figures

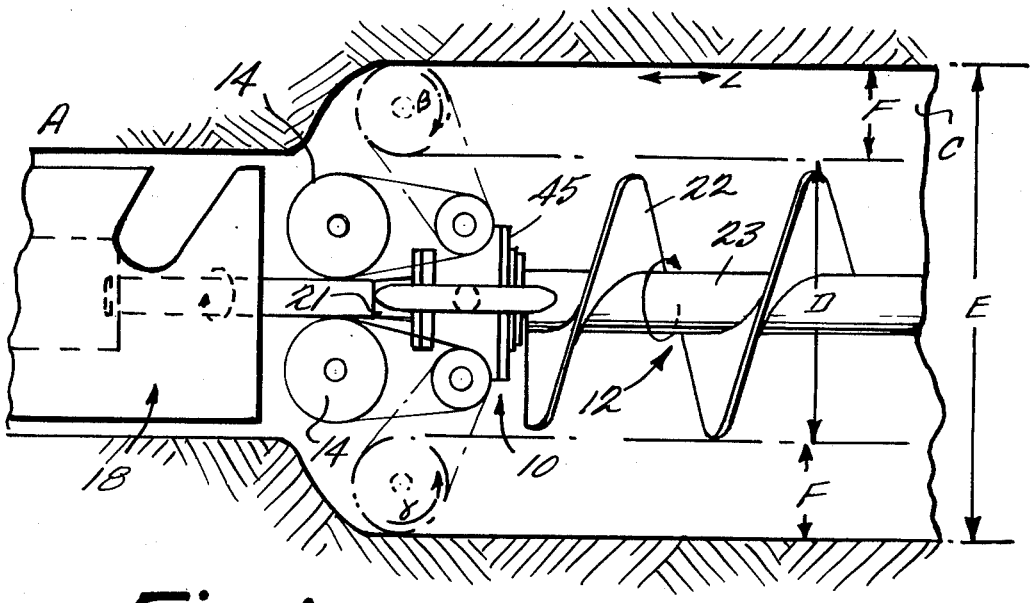
Fig. 1
Fig. 2
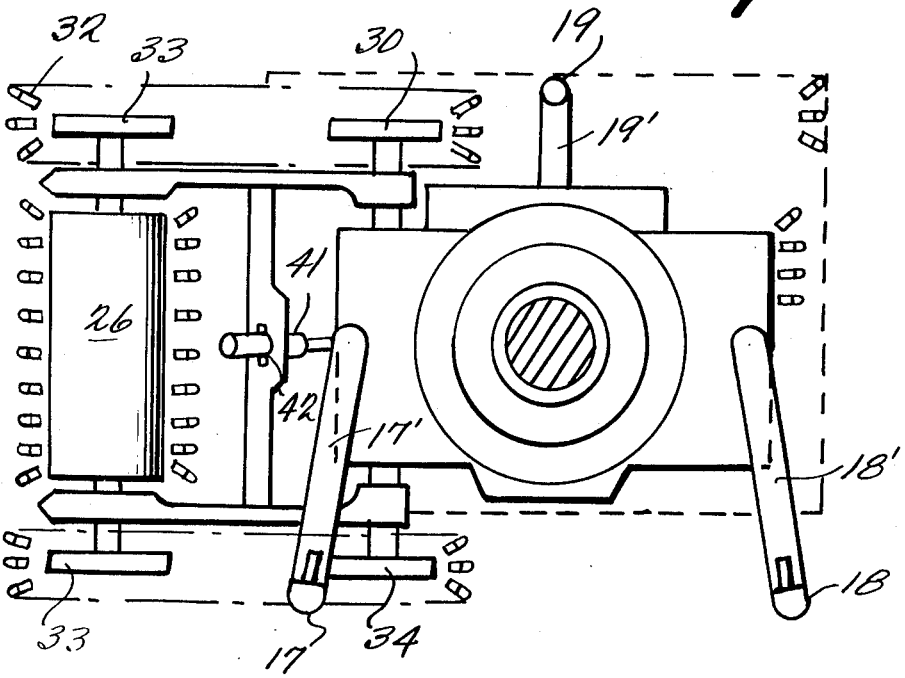

APPARATUS FOR COAL MINING IN-CUTTING AND OUT-CUTTING

CROSS REFERENCE TO RELATED APPLICATIONS

This application is a continuation-in-part of copending application Ser. No. 649,579, filed Jan. 16, 1976, now U.S. Pat. No. 4,003,602.

BACKGROUND AND SUMMARY OF THE INVENTION

The invention relates to apparatus for the formation and/or enlarging of generally horizontal bores for the mining of coal, ore and the like. In the past, coal has often been mined with conventional auger-miners (such as shown in U.S. Pat. No. 2,784,955) and the like by boring a generally circular cross-section bore into a coal seam. Bores must be spaced far enough from each other to make sure that collapse of the bores does not occur, however, in many older mines these bores are much farther apart than necessary. In mining in such a method, generally the maximum amount of coal is not recovered from an area both because of the shape of the bores and because the area in between bores is wasted.

According to the present invention, apparatus is provided for enlarging pre-existing bores both by changing the cross-sectional shape and the cross-sectional area thereof, and additionally for forming new bores and removing ore during both movement of the mining machine into and out from the bore (the invention is also applicable to underground mining). Conventional mining machines, such as shown in U.S. Pat. Nos. 2,784,955; 3,105,677; 3,121,558; 3,190,698; 3,210,123; and 3,333,898 are capable only of mining during movement of the mining machine into a formation to form a bore therewith, and not during withdrawal of the machine. The machine and method according to the present invention result in the advantages of less wasted set-up time and the like for mining with a machine of a given size, the mining of larger bores with a machine of a given size, and the capacity to retrieve coal, ore and the like from bores that have previously been made, which coal, ore and the like has been up to now unusable. All of this can be accomplished with safety since operators are never required to go into the bores being formed or enlarged.

According to the present invention, a mining machine is provided that has a non-rotatable body member in line with a conveying means, and a pair of wing-cutters. The wing-cutters are generally formed by rotatable cutting drums pivotally mounted on lever arms to the body member, and generally driven by cutting chains or the like. During movement of the machine into a pre-existing bore, the wing-cutters are in a position substantially in line with the body member and the conveyor, the mining as a whole presenting a cross-sectional area about the same as or slightly less than that of the pre-existing bore. Once far enough into the bore, the wing-cutters are then moved to a position wherein they are disposed outwardly with respect to the body member, and they are held in that outward position while the rotatable drum cutting portions thereof are normally rotated in a direction outwardly from the body member, each drum rotating in a different direction than the other. The machine is withdrawn with the wing-cutters in this position, and cutting takes place the whole time during withdrawal, the coal or the like being thrown toward the conveying means, which preferably comprises an auger.

For both in and out cutting, preferably a pilot cutting head is provided for the machine, in line with the body member and the conveying means. The pilot head preferably is a conventional type such as disclosed in U.S. Pat. No. 2,784,955, the disclosure of which is hereby incorporated by reference in the present application. Also, the chains which drive the cutting drums preferably are cutting chains and they may be arranged so that a circular hole of diameter D cut by the pilot cutting head is enlarged during in-cutting to a square [rectangular] hole of dimension D sides.

In order to increase the efficiency of the coal transport during out-cutting means for moving the coal cut by the wing-cutters during out-cutting towards the sides of the bore may be provided Such sideward moving means may include shield means associated with each of the wing-cutters and mounted for pivotal movement with the wing-cutters, the shield means comprising a shield associated with each cutting drum and extending essentially the length of the cutting drum (but not overlapping the cutting chain associated with the cutting drums), and termination of each shield is coplanar with the associated cutting drum axis and the parellel axis associated with the body member about which the cutting drum is pivotal. The coal moving means also includes a generally conical member coaxial with the shaft for rotation of the pilot head and mounted between the pilot head and the wing-cutters. Means for stabilizing the body member may include a pair of wheel sets spaced along the length of the conveying means, and a pair of right angle or vertical guide members vertically displaced from the wheel structure. The back-wheel set may comprise a pair of vertically spaced wheels, the upper wheel of which engages the roof and is vertically adjustable. Where the conveying means is in auger having a central shaft, the auger sections that are added to the auger may have a pair of stabilizing support assemblies with skids or wheels and a power source conduit may extend through the shaft or between corresponding legs of the stabilizing supports.

If roof cutting is desired for seams that are higher than may be cut by the pilot cutting head and the wing-cutters, cutting means for cutting the roof of the bore may be provided. Such cutting means may include a cutting drum rotatable about a generally horizontal axis, and means for rotating the cutting drum about the axis, such rotating means including a mounting for a horizontal shaft which mounting is stationary with respect to the body member, and a pair of chain cutters disposed between a gear end of the cutting drum and a gear mounted at an end of the shaft associated with the stationary mounting. Means — such as hydraulic cylinders — may be provided for horizontally moving cutters at the ends of the cutting drum with respect to the mounting and the body members so that the roof cutting can be effected during out-cutting to produce a wider roof cut than during in-cutting. Additionally, arms mounting the cutting drum are associated with a hydraulic cylinder or the like for pivoting the cutting drum with respect to the stationary mounting to adjust the vertical position of the cutting drum.

Conveying means may be associated with the cutting head according to the invention that save energy over an auger conveyor, yet are useful for conveying coal from the locations in which the machine according to the present invention is employed. Such conveying means include a double helix distributor member mounted on the pilot cutting head shaft posterior of the wind-cutters for agitating and distributing the cut coal. Scoop means are disposed posterior of the distributor member and have a bottom portions substantially abutting the bore floor and extending posteriorly therefrom at a positve angle, and having side members that funnel toward the shaft. A conveyor belt is disposed posterior of the scoop means, the scoop means bottom portion and side members funnelling toward the conveyor belt and a top transporting surface of the conveyor belt being disposed adjacent the termination of the scoop means bottom portion and side members. The drive shaft is vertically spaced from the conveyor top portion in non-interfering relationship therewith. Preferably, the angle formed between the scoop means bottom and the floor is 12°, but in any event it is preferably less than 14°. An auger section may be provided on the shaft posterior of the double helix, the auger section having continuously decreasing flight diameter from the double helix toward the scoop means, the auger section disposed above the bottom portion of the scoop means for conveying cut coal up the scoop means. The conveyor belt preferably includes an anterior portion having rollers adjacent the termination of the scoop means, and having posterior portions comprising forming a trough for supporting the conveyoyr belt surface. Add-on sections are provided for the shaft and the conveyor belt, each add-on section including vertically extending supports for supporting the limber rollers, stabilizing means for engaging the formed bore, and a bushing collar supported by the vertical extending supports for mounting the shaft.

It is the primary object of the present invention to provide an improved apparatus for the mining of coal, ore and the like. This and other objects of the invention will become apparent from an inspection of the detailed description of the invention, and from the appended claims.

BRIEF DESCRIPTION OF THE DRAWINGS

FIG. 1 is a top plan view showing an exemplary machine according to the present invention schematically in operation during cutting;

FIG. 2 is a front view with the pilot head cutaway of the machine of FIG. 1;

DETAILED DESCRIPTION OF THE INVENTION

Figure 3:
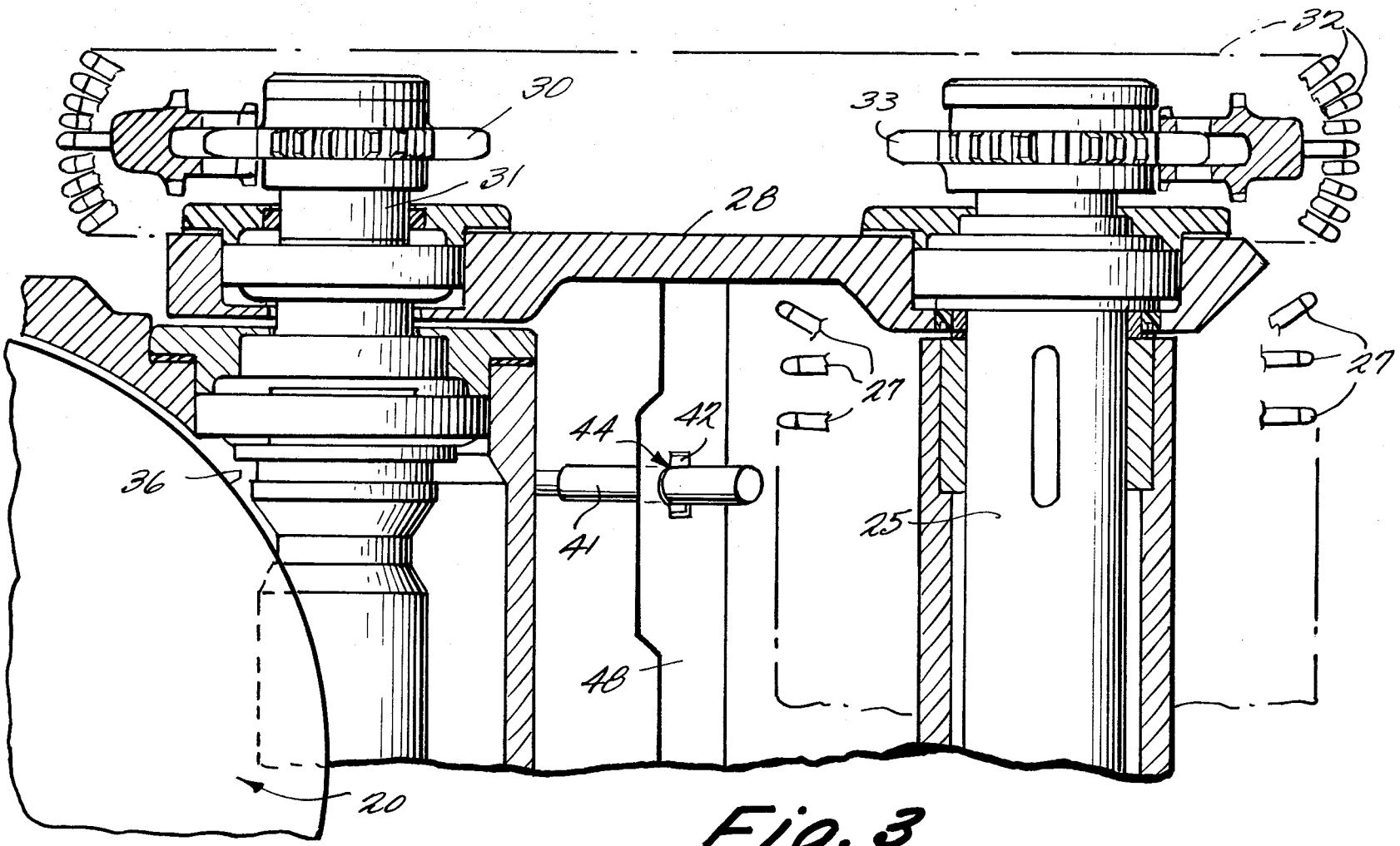
FIG. 3 is a detailed view partly in cross-section and partly in elevation of a portion of a wing-cutter with drive means therefor of the machine of FIG. 1.

An exemplary mining machine according to the present invention is shown schematically in FIG. 1. The machine generally comprises a non-rotatable body member 10, conveying means 12 in line with the body member 10 and for conveying cut coal and the like from the cutting side and a pair of wing-cutters 14 for cutting coal during back-movement of the machine from a bore A in which it is inserted. A pilot cutting head 16 preferably is provided in front of the body member 10 in line with the member 10 and conveying means 12 to provide for in-cutting with the machine, as well as the out-cutting therewith provided by wing-cutters 14. The pilot head preferably comprises a conventional type such as shown in U.S. Pat. No. 2,784,955, the disclosure of which is hereby incorporated by reference in the present application. Ski runners 17 18 and 19 or the like are provided attached to the body member 10 for "keying" the body member into the bore to prevent rotation thereof, and for stabilizing it during cutting.

The legs 17', 18' and 19' supporting the ski runner 17, 18 and 19 may have the length or position thereof manually adjusted (as with shims) or automatically adjusted by power means, such as a hydraulic cylinder. Such means may be used for guidance purposes, and be operable in response to a securing means. Other stabilizing means are shown in FIGS. 6–9 at 64, and will be described more fully hereinafter.

The body member 10 contains a transmission, shown generally at 20 (see FIG. 3) therein, which transmission 20 is operatively connected to the pilot cutting head 16 by a head coupling 21 or the like, and is connected at the other end thereof to a drive shaft (not shown) extending through the conveying means 12. Preferably, the conveying means 12 is an auger 22 so that the drive shaft may extend through the middle shaft 23 thereof. However, where the conveying is to be over a relatively long distance, the conveying means 22' shown in FIGS. 13–15 may be utilized, as will be more fully explained hereinafter.

Each of the wing-cutters 14 preferably includes a shaft 25 that is rotatable about a generally vertical axis during use of the mining machine, a cutting drum 26 mounted for rotation with the shaft 25 having teeth 27 formed on the periphery thereof, and one or more (preferably at least two) lever arms 28 pivotally mounting the shaft 25 to the body member 10. A drive sprocket 30 is mounted on a drive shaft 31 which extends from transmission 20 through upper arm 28 to a position above body member 10, and sprocket 30 is mounted to a cutting chain 32; the drive sprocket 30 drives a driven sprocket 33 mounted to shaft 25, above arm 28, via chain 32. The cutting chain 32 may be of any conventional type, such as Cincinnati Rap-Lok Chain No.

1997. The driven sprocket 33 is preferably larger than the drive sprocket 30 so that draft is allowed when the chain 32 is not in line with the dimension L of the bore A. A cutting chain 32 is also provided on the bottom of each drum 26, also attached to a sprocket 33, and to a sprocket 34. The sprocket 34 may either be an idler sprocket, or it may be connected to shaft 31 at the bottom thereof, opposite sprocket 30. The transmission 20 for driving the cutting drum 26 and cutting chains 32 preferably includes a circular gear 36 or the like connected to the shaft extending through the conveying means 12, and a worm gear 37 connected to shaft 31. As the circular gear 36 is driven, powered by a diesel engine or the like located exteriorly of the bore a, it rotates the worm 37, which powers the whole wing cutter assembly 14. The speed of rotation of the gear 36 is of course variable.

Figure 4:
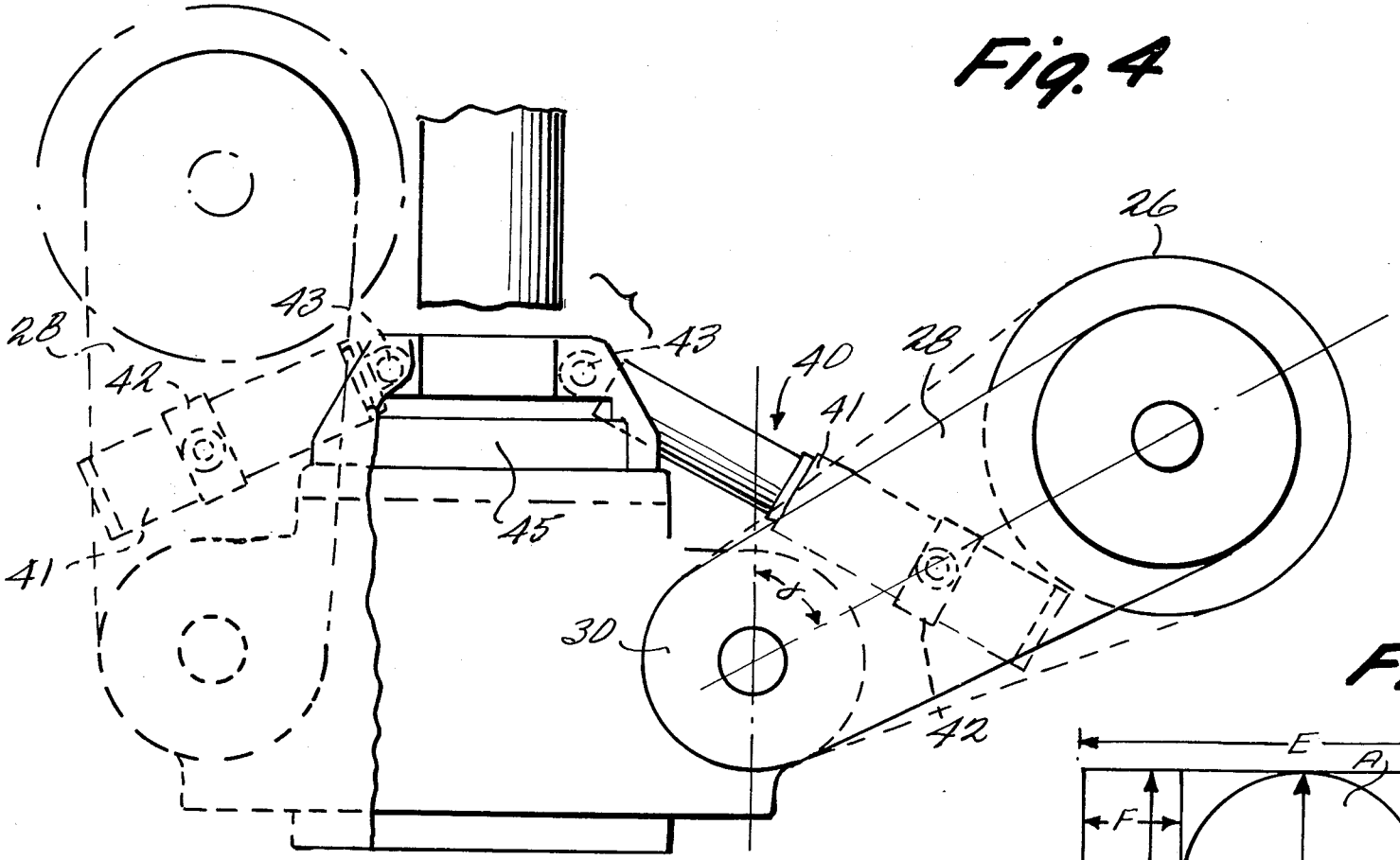
FIG. 4 is a top view with portions cutaway for clarity of exemplary means for moving the wing cutters with respect to the body member of the machine of FIG. 1.
Figure 5:
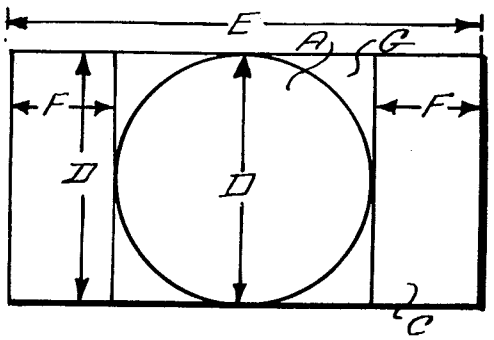
FIG. 5 is a schematic view of exemplary bores formed according to the present invention.

Each of the wing cutters 14 is pivotally mounted, by arm(s) 28, to the body member 10 so that they are movable from a first position (shown in solid line in FIG. 1) wherein they are generally in line with the body member 10 and conveying means 12 (the arms 28 generally being parallel to a line through body member 10, pilot head 16, and conveyor means 12), to a second position (shown in dotted line in FIG. 1) wherein they are disposed outwardly with respect to the body member 10, the arms 28 making an angle $\alpha$ with respect to the in-line first position thereof. Means, shown generally at 40, are provided for moving the cutter means 14 from the first position thereof to a second position thereof, and vice-versa. Such means 40 may take the form of a hydraulic cyliner 41, such as shown in FIGS. 3 and 4, especially, mounted by a bracket 42 adjacent one end thereof in an opening 44 in a support 46 extending between arms 28, and at the other end thereof by a pin 43 or the like to the body member 10, or an extension thereof. Of course more than one cylinder 41 could be provided with each support 46 or like structure if desired. Adjustable control means 45 or the like are provided for controlling the extension of cylinder 41 to in turn control the extent the arm 28 is pivoted outwardly with respect to the body member 10 (control the magnitude of the angle $\alpha$). The control means 45 provide for latching of the cylinder 41 into any position to which it is moved. The extent to which it is desired to extend each cylinder 41 will depend upon the particular bore involved, the position which will maximize the cutting forces, etc., and one cylinder 41 can be extended to a greater extent than the other if desired in some circumstances.

The cutting drums 26, and associated cutting chains 32, are preferably rotated outwardly with respect to the body member 10, the direction of rotation of each drum 26 being opposite the direction of rotation of the other drum. That is, the right-side drum 26, as viewed from the conveying means 12, preferably rotates in direction $\beta$ (clockwise) so that coal or the like cut thereby is thrown toward the auger 22, and the left-side drum 26 preferably rotates in the direction $\gamma$ (counterclockwise) so that coal or the like cut thereby is thrown toward the auger 22.

An exemplary operation of the mining machine according to the present invention for both cutting in and out, will now be described. The cylinders 41 are retracted so that the wing cutters 14 are disposed in their first, in-line position (solid line in FIG. 1) with the body member 10. An engine located exterior of the area to be mined is started up and the pilot head 16 is powered by a shaft extending from the exterior area, through auger 22 and transmission 20, to the pilot head 16. The pilot head 16 cuts a generally circular bore A having a diameter D. As the coal or the like is cut by the pilot head 16, it is automatically moved backwardly toward the auger conveyor 22, which has substantially the same diameter D as the bore A being formed by pilot head 16. During this time, while the wing cutters may be powered (or a clutch or the like could be provided with transmission 20 to cut-out the wing cutters 14 during in-cutting), the wing cutter drums 26 perform no substantial cutting, although they can be at a slight angle $\alpha$ to perform a small amount of cutting and to insure clearance of cylinders 41 during outward movement. Once the desired depth is reached for bore A, the cylinders 41 are extended a desired amount (i.e. dotted line position of FIG. 1), while the wing cutters 14 are being powered through the transmission 20 by the drive sprockets 30 and the like, and the mining machine is withdrawn from the bore A. During the withdrawal operation a generally rectangular bore C is formed, having a width E, equal to the diameter D plus the amount F each cutting drum 26 extends from the bore A in a dimension M, perpendicular to the dimension L of the bore A, and having a height D. The dimension F cannot be greater than the diameter of the cutting drums 26 unless a string of wing cutters 14 is provided on each side of the body member 10, mounted on arms (28) of various lengths. The cut coal or the like is thrown toward the auger 22 due to the direction of rotations, $\beta$ and $\gamma$ respectively, of the right-hand and left-hand cutting drums 26. Once the entrance of the bore A is approached, the wing cutters 14 are collapsed to their first, generally in-line position, and the whole mining machine withdrawn (an area of bore A, instead of bore C, is desirably left adjacent each bore entrance).

Preferably, as shown in the drawings, the cutting chains 32 are so arranged that during in-cutting with the pilot head 16, the circular bore of diameter D is transformed by the cutting chains 32 into a generally square [rectangular] bore G having each side of dimension D. The cut coal or the like is of course continuously withdrawn from the bore G by the auger 22.

Figure 6:
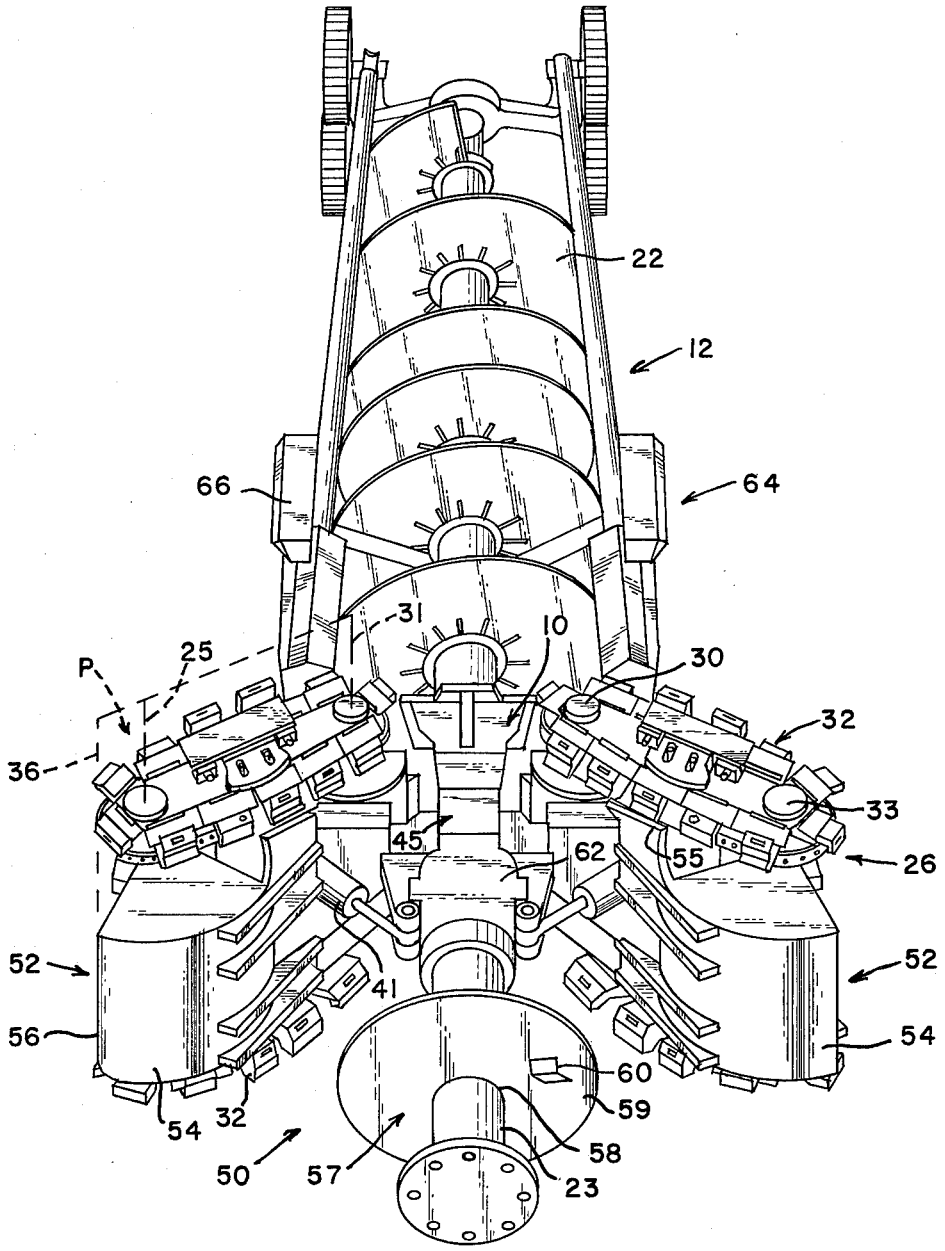
FIG. 6 is a perspective view — with the pilot cutting head removed — of the machine of FIG. 1 also including structures for moving the cut coal to the sides of the bore, and a modified form of stabilizing structure.

Although the structure shown in FIGS. 1–4 is very useful, if it is desired to insure that a minimum amount of cut coal is left in the bore during the removal of the machine during out-cutting, means 50—as shown in FIG. 6— are provided for forcing the coal towards the sides of the bore during the out-cutting. Such means 50 include shield means 52 associated with each of the wing-cutters 14. The shield means includes a pair of shields 54, each shield mounted on a set of mounting arms 55 for pivotal movement with the wing-cutters 14 with respect to the body member 10. The shields 54 — as clearly shown in FIG. 6 — are disposed between the cutting drum 26 of the wing-cutter and the body member 10 and pilot head 18. Preferably, the edge termination 56 of each shield 54 is disposed so that it is coplanar (in Plane P shown in dotted line in FIG. 6) with the axis of shafts 25 and 31 associated with the wing-cutter 14. Additionally, the shields 54 extend only the length of the cutting drums 26, and do not overlap the cutting chains 32 disposed on the top and bottom of each wing-cutter 26.

Means also may be provided for facilitating even distribution of coal to the sides during in-cutting to be transported out of the bore, and such means may take the form of a generally conical member 57 that is coaxial with shaft 23 and is mounted to shaft 23 for rotation therewith between the pilot head 18 and the wind-cutters 14. The generally conical member 57 has a frustum 58 disposed closer to the pilot head 18 along the shaft 3 than the base portion 59 of the member 57. An agitator 60 may be affixed to the exterior of the conical member for rotation therewith, the agitator comprising an angle section welded to the exterior of the member 57, or a like agitating structure. Instead of using the conical member 57, the shields 54 may be so shaped that when the wing cutters are in their collapsed position (solid line, FIG. 1), the shields 54 encircle the shaft 23 and present a curved surface thereat to deflect cut coal to the bore sides. When the shields 54 are then moved outwardly with the wing-cutters, they still function to scrape the cut coal along the bore sides during out-cutting.

A different form of stabilizing means can be employed than the stabilizers 17, 18, 19, etc., shown in FIGS. 1–4. Such modified stabilizing means are shown at 64 in FIGS. 6–9. The means 64 include a pair of wheel sets 65, 65', spaced along the length of the conveying means (i.e., auger 22) and a pair of right-angle guide members 66 vertically displaced from the anterior wheel sets 65. As can be seen in FIG. 9, the right-angle members 66 engages the corner of the bore formed during in-cutting (the bore corners being formed by the cutting chains 32 and being of slightly larger dimension than the portions formed by the drums 26), and in combination with the wheel sets insure that the head 18 is positively guided into the bore A during cutting period.

The back wheel sets 65' preferably comprises a lower wheel 67 for engaging the floor of the bore, and an upper 68 for engaging the roof of the bore, disposed on each side of the conveying means 22. Preferably, an adjustment slot 69 or the like (see FIG. 7) is provided in the support for the upper wheel 68 to allow vertical adjustability thereof so that engagement with the roof is always provided, and the lower wheel 67 may be adjustable also. If the power source for the cutting head 18, wing-cutters 16 and hydraulic cylinders 41 is to be provided from an external source (rather than mounted directly with body member 10) one or more power source conduits 70 may be provided associated with the conveying means 22. The power source conduits are parallel to the shaft 23 and contain electric cables, hydraulic cables or the like.

Figure 7:
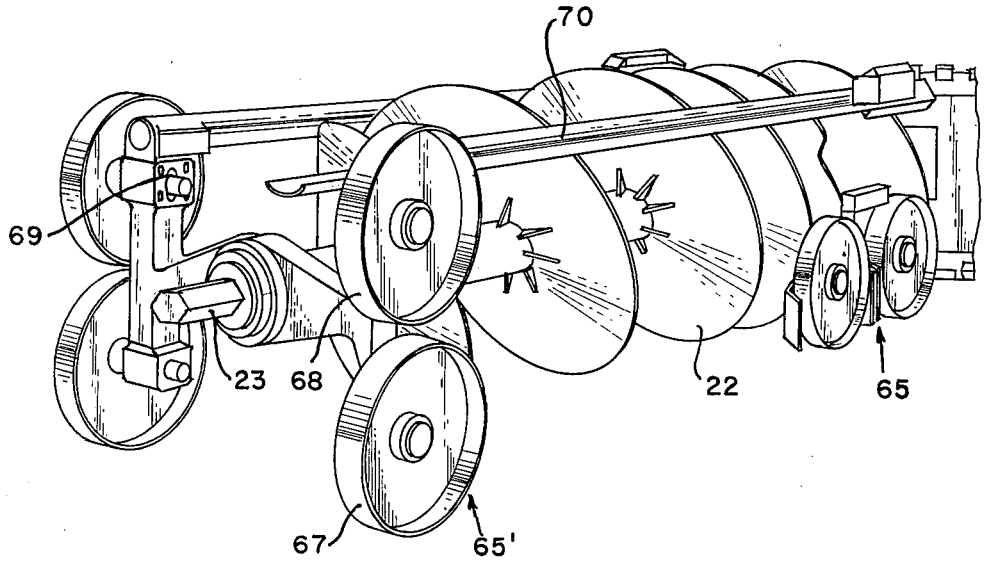
FIG. 7 is a back perspective view of the first auger conveying section of the modified machine of FIG. 6.
Figure 8:
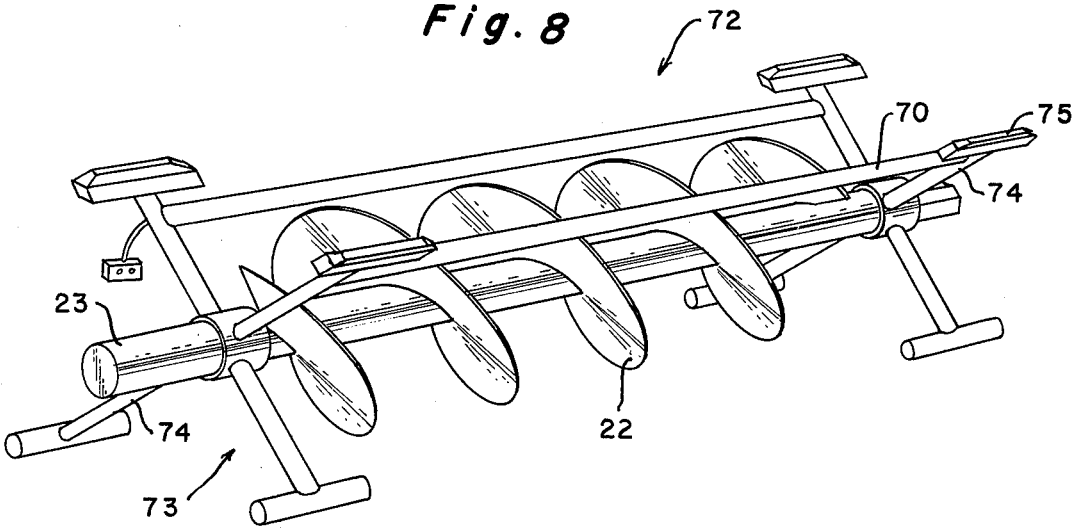
FIG. 8 is a perspective view of add-on auger sections that are utilizable with the auger section of FIG. 7.
Figure 9:
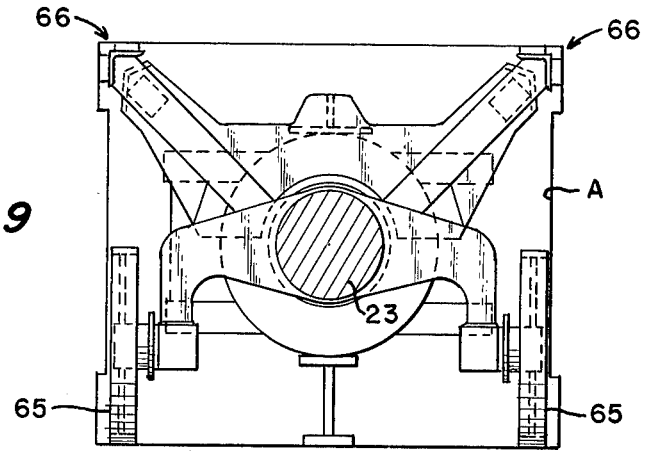
FIG. 9 is a cross-sectional view of the modification of FIG. 6 taken at the front of the first auger section.

Add-on sections to be connected to the first auger section 22 as shown in FIG. 7 are shown at 72 in FIG. 8. Each add-on section 72 preferably includes stabilizers 73 having arms 74 with runner 75 disposed at the termination of the arms 74, the stabilizers 73 providing bushings for the shaft 23 associated with the auger 22 of the auger section 72. The conduit (as in 70) extends between corresponding arms 74 of the stabilizers 73, the conduit 70 being parallel to the shaft 23 and in non-interfering relationship with the auger 22.

The embodiment of FIGS. 6–9 is especially useful for maintaining true direction of the cutting head 18 and for recovering all of the coal cut by the cutters 16. Modifications of this structure also are possible, however, for instance instead of tandem front wheel 65 a single front wheel arrangement may be provided, a protective plate 62 may be provided over the control means 45 or the like, and the shield structures 54 — instead of terminating short of the cutting chains — may be formed so that they extend the whole length of the cutting chains 32 and drums 26 in order to scrape all of the cut coal during the backward movement.

Figure 12:
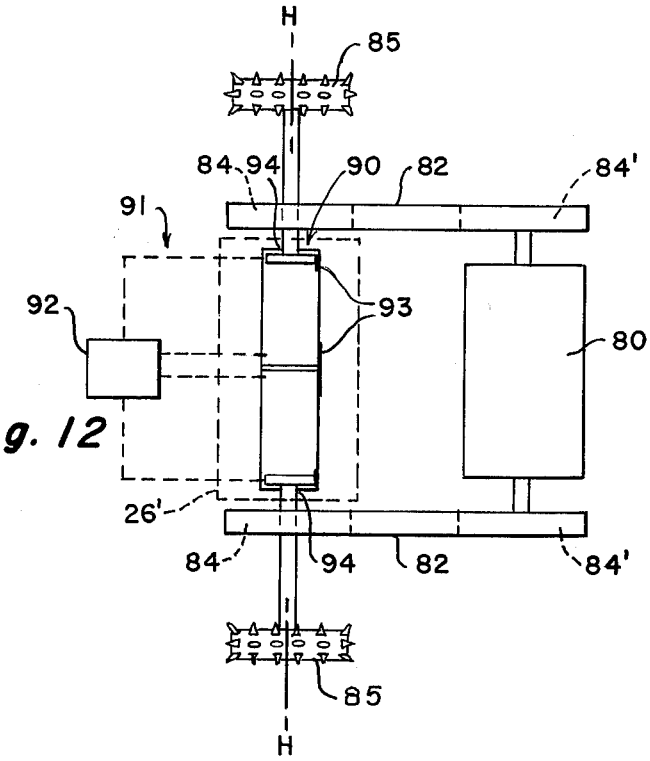
FIG. 12 is a schematic view of the means for horizontally moving the exterior cutters of the roof cutter of FIGS. 10 and 11.
Figure 11:
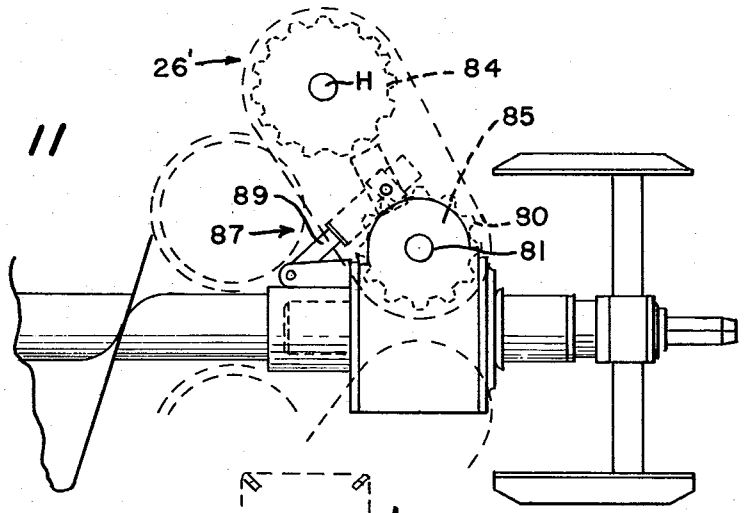
FIG. 11 is a side view — with the front cutting portions cutaway — of the machine of FIG. 10.
Figure 10:
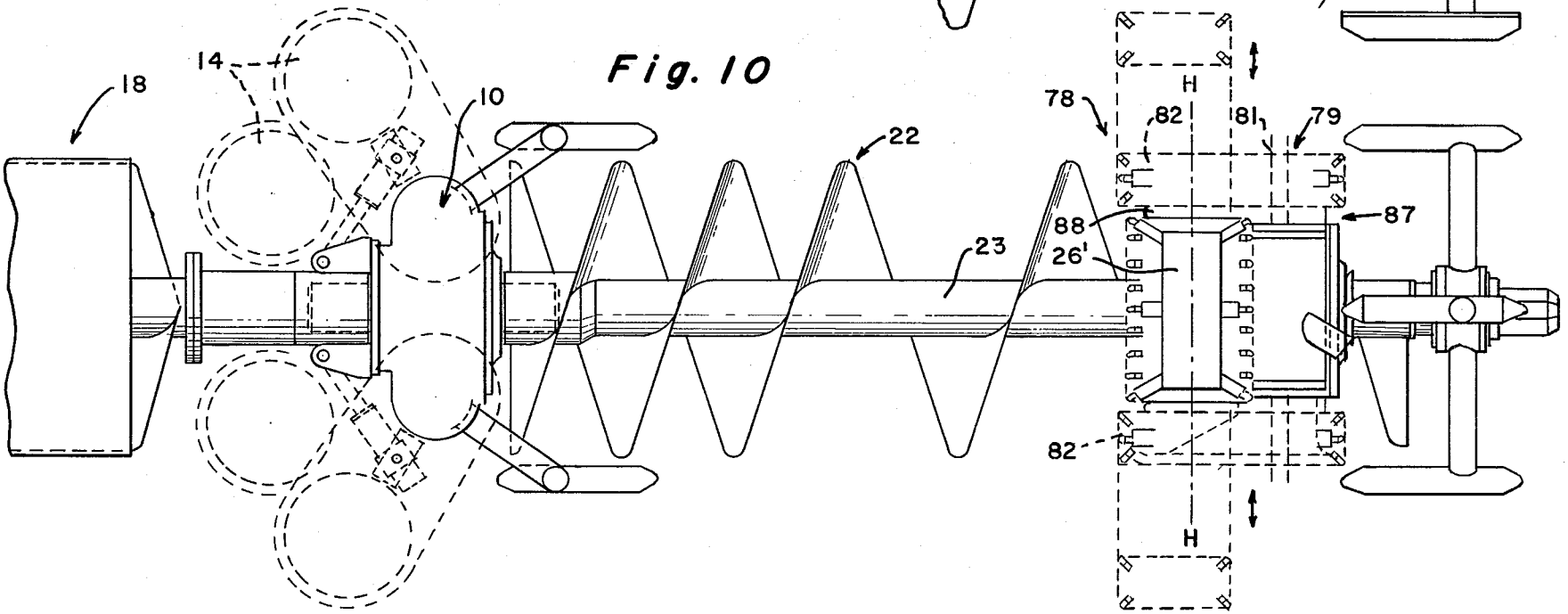
FIG. 10 is a top plan view of a modified form of the machine of FIG. 1 showing a roof cutter associated therewith.

In many coal seams in which pre-existing bores have been formed, or in boring new coal seams, sometimes it is also desirable to make a cut that is higher than the height of the pilot head 18 and cutting drums 26 with cutting chains 32, in order to recover the maximum amount of coal from the seams. In such instances, a roof cutter, such as shown in FIGS. 10–12 may be utilized. While roof cutters per se have been known in the art (i.e. see U.S. Pat. No. 3,333,898), such roof cutters have not had the capability of cutting different sized horizontal swaths during in-cutting and out-cutting. Of course the cutting of different sized horizontal swaths during in-cutting and out-cutting is necessary for use with the wing-cutters according to the present invention in order to get maximum recovery of coal. Roof cutting means according to the invention are shown at 78 in FIGS. 10–12. The roof cutting means 78 include a cutting drum 26' rotatable about a generally horizontal axis H—H and means 79 for rotating the cutting drum 26' to effect cutting. The rotating means 79 includes a mounting 80 for a horizontal shaft 81, the mounting 80 being fixed relatve to the non-rotative body member 10, and preferably spaced from the body member 10 along the shaft 23. The auger section 22 that is disposed between the body 10 and shaft mounting 80 may include a double helix section as shown in FIG. 10. A pair of chain cutters 82 are provided at either end of the shaft 81 and drum 26', each chain cutter connected between the cutting drum gear end 84 and the shaft 81 gear end 84' rotation of the gears 81 by any suitable power source resulting in the rotation of chains 82 and cutting drum 26' and subsequent cutting thereby. A pair of horizontally movable cutters 85 (see FIG. 12) are also provided, one on either end of the drum 26' exterior of the gears 84. Means 86 are provided for moving the cutters 85 horizontally with respect to the mounting 80 and body member 10 so that roof cutting can be effected during out-cutting to produce a wider swath than during in-cutting. Means 87 are also provided for mounting the cutting drum axis H-H for pivotal movement with respect to the horizontal shaft mounting 80 and the body member 10 to adjust the vertical position of the cutting from 26', the mounting means including a pair of arms 88 mounted between the shaft 81 and the end of the drum 26'. A hydraulic cylinder 89 or other suitable power means are provided for pivotally moving the cutting drum axis H—H.

Referring to FIG. 12 of the drawings, the means 86 for horizontally moving the cutters 85 are shown in schematic. The means 86 include a dual piston and cylinder arrangement 90 associated both with the cutting drum 26'. The shaft mounting gear 84 is formed by a dual piston and cylinder arrangement, and defines horizontal axis H—H associated with cutting drum 26'. Hydraulic lines 91 lead from the dual hydraulic cylinders to a hydraulic fluid source 92 or the like, and conventional rotary hydraulic seals 94 are provided for supplying fluid to the cylinders 90. Since the piston-cylinder arrangements 90 are rotatable, the pistons are keyed to the cylinders for rotation therewith by keys 93, and the cylinders are keyed to drum 26' by a key 93. During out-cutting, hydraulic fluid is controlled from source 92 to the piston cylinder arrangements 90 to horizontally move the cutters 85 back and forth with respect to the stationary mounting 80 to effect roof cutting.

Figure 14:
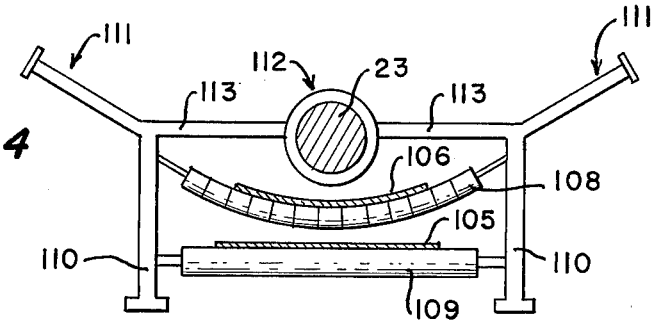
FIG. 14 is an end view taken along lines 14—14 of FIG. 13 showing the particulars of the conveyor belt and conveyor belt supporting structure.
Figure 13:
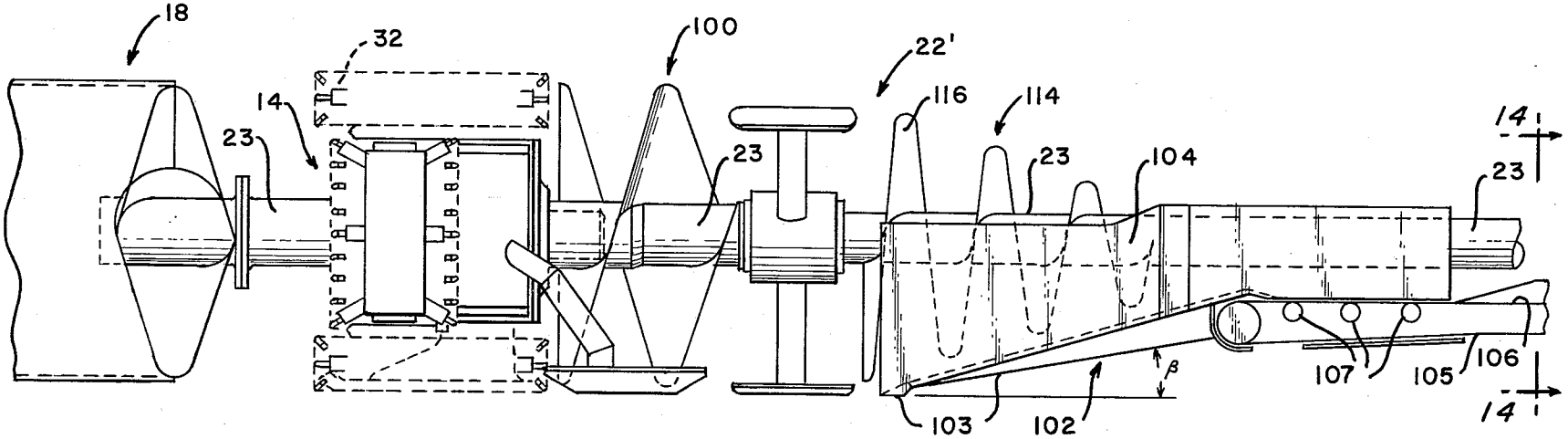
FIG. 13 is a side view of the cutter of FIG. 1 showing an energy-saving conveying structure.
Figure 15:
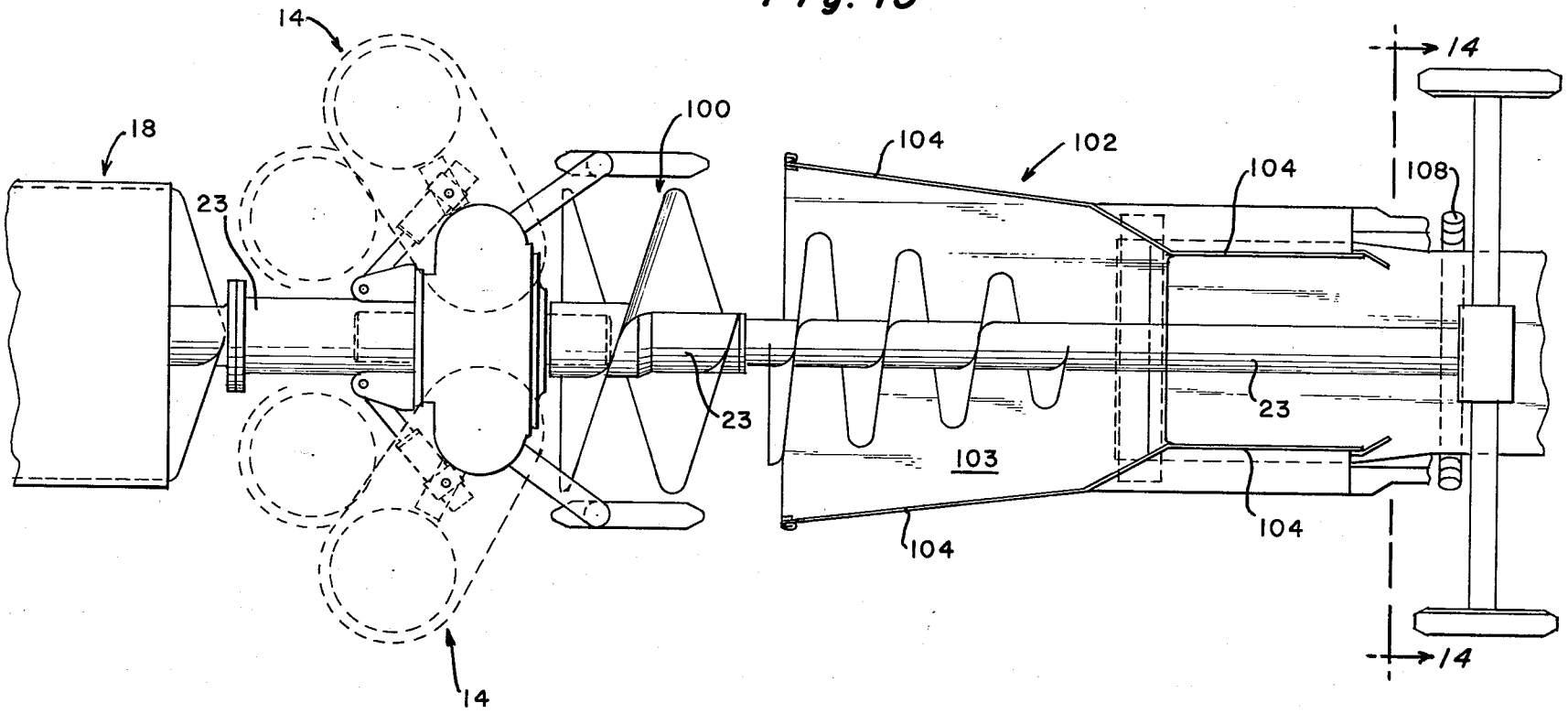
FIG. 15 is a top plan view of the modification of FIG. 13.

In many situations, especially where the bore formed by the machine according to the present invention is very long, the reduction in the energy consumption of the conveying means is important. The conveying means 22' shown in FIGS. 13–15 is specifically designed to effect proper transport of coal cut by the machine while reducing the energy penalty associated with the conveyance as compared to the auger 22 of FIG. 1.

The conveying means 22' comprises a double helix distributor member 100 mounted on the shaft 23 posterior of the wing-cutters 14, the member 100 agitating and distributing the cut coal. Scoop memas 102 are disposed posteriorly of the distributor member 100 and have a bottom portion 103 substantially abutting the bore floor and then extending posteriorly therefrom at a positive angle $\beta$ the scoop means 102 also having side members 104 that funnel toward the shaft 23 (see FIG. 15). In order for optimum operation, the angle $\beta$ is preferably about 12°, although any angle $\beta$ less than about 14° is operable to effect proper conveyance of the coal during cutting according to the present invention. A conveyor belt 105 is disposed posteriorly of the scoop means 102, the scoop means bottom portion 103 and side members 104 for funnelling toward the conveyor belt 105. A top, transporting surface 106 of the conveyor belt is disposed adjacent the termination of the scoop means bottom portion 103 and side members 104. Where the power source is external and a drive shaft is provided along the length of the conveyor belt 105, the shaft 23 is vertically spaced from the conveyor top 106 in non-interfering relationship therewith.

The anterior portion of conveyor belt 105 preferably has a plurality of rollers 107 supporting the top surface 106 therefor. Each of the rollers 107 may comprise a roll of solid metal (i.e., hardened steel) with a rubber or other resilient coating thereon. The provision of such rollers is desirable in order to minimize the adverse effects from the coal impacting on the conveyor belt at this anteriormost point of the conveyor belt. The rest of the conveyor, except for the anteriormost portion, is supported by rollers 108 (see FIG. 14 in particular) which operate with the conveyor belt 105 to form a curved conveying surface or trough to insure the retention of the cut coal or the like thereon. Each roller 108 may consist of a flexible shaft and a plurality of segmented resilient roller members. Bottom rollers 109 are provided associated with each roller 108 for supporting the bottom surface of the conveyor (see FIG. 14).

A plurality of add-on sections may be provided for the shaft 23 and conveyor belt 22, each add-on section comprising vertically extending supports 110 for supporting the rollers 108, stabilizing means 111 for engaging the formed bore, and a bushing collar 112 supported by the vertically extending supports 110 and support arms 113 for mounting the shaft 23 for rotation. As many add-on sections may be provided as necessary, a conveyor belt storage system may be provided for feeding out belts as needed when add-on sections are employed.

Although in normal operation of the machine, cut coal will be moved up the scoop bottom portion 103 by the forward movement of the whole machine, in order to facilitate movement of the scoop means bottom portion an auger section 114 may be provided associated with the central shaft 23 and located posterior of the distributor member 100 and above — but in cooperation with — the scoop bottom 103. Since the scoop bottom 103 is disposed at an angle $\beta$ the auger flights 116 are of continuously decreasing diameter from the double helix 100 toward the conveyor belt 105.

During out-cutting, the auger section 114 or same like means is especially desirable to facilitate the movement of coal onto the conveyor belt 105.

It will thus be seen that according to the present invention, a machine has been provided that allows the cutting of a much larger amount of coal for a machine of a given size during one entry and exit operation, contributing to economy of removal. It is noted that this is accomplished essentially without danger to any operators since the operators have no reason to enter a bore A, G or C. Should collapse of a bore result, while the mining machine will be lost, no loss of human life will ensure. The machine according to the present invention also distributes the cut coal toward the sides so that more complete removal of the cut coal from a bore may be provided, and roof cutting may also be provided for seams that are larger in height than the cutting heads, roof cutting also being over a wider swath during out-cutting than in-cutting. Additionally, an energy-saving conveyor system can be associated with the pilot and wing-cutters for distributing the cut coal, scooping it up, and transportng it on a conveyor belt from the cutting site.

While it is preferred that the apparatus according to the present invention be primarily utilized for coal mining, it is to be understood that ore and the like may also be mined thereby. The term "coal or the like" in the claims is thus intended to encompass coal, and a variety of ores and similar materials.

While the invention has been herein shown and described in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent structures and devices.

We claim:

1. A mining machine for cutting an in-bore and an out-bore larger than said in-bore during in-cutting and out-cutting respectively, comprising (a) a non-rotatable body member, with stabilizing means for insuring non-rotative movement of said body member in a bore, (b) a rotatable pilot cutting head, mounted in front of said body member, and means for rotating said pilot cutting head for cutting a generally circular in cross-section bore, said means for rotating said pilot cutting head including a rotatable shaft extending through said non-rotatable body member to said pilot head, (c) a pair of wing-cutters pivotally mounted to said non-rotatable body member behind said pilot head in non-interfering relationship with said pilot head, (d) conveying means mounted behind said wing-cutters in operative association with said body member, for conveying coal or the like cut by said pilot head and said wing-cutters away from the cutting site, (e) means for pivotally moving said wing-cutters with respect to said non-rotatable body member from a first position, wherein said wing-cutters are in general alignment with said pilot cutting head and body member, during in-cutting to a second position wherein each of said wing-cutters extends outwardly with respect to said pilot cutting head, during out-cutting, (f) means maintaining said wing-cutters in said second positions thereof during out-cutting thereby, and (g) means for moving coal or the like cut by said wing-cutters during cutting toward the sides of the bore cut thereby, said means including (i) shield means associated with each of said wing cutters mounted for pivotal movement with said wing-cutters with respect to said body member, said shield means including a pair of shields, one associated with each wing-cutter, and disposed between said wing-cutter and said body member and said pilot head, and (ii) means surrounding said shaft for moving coal cut during in-cutting to the bore sides.

2. A machine as recited in claim 1 wherein said means surrounding said shaft for moving coal cut during in-cutting to the bore sides includes a generally conical member coaxial with said shaft for rotation with said pilot head, and mounted to said shaft between said pilot head and said wing-cutters, said generally conical member having a frustum portion disposed closer to said pilot head along said shaft than a base portion.

3. A machine as recited in claim 1 wherein said stabilizing means comprises a pair of wheel sets spaced along the length of said conveying means, and a pair of right-angle guide members vertically displaced from the wheel structure of one of said wheel sets.

4. A machine as recited in claim 1 wherein said conveying means comprises an auger conveyor and wherein said stabilizing means comprises a pair of sets of vertically spaced wheels, each set disposed on opposite sides of said auger member, one wheel of each set engaging the roof of the bore being cut, while the other wheel of each set engages the floor of the bore being cut.

5. A machine as recited in claim 4 further comprising means for adjusting the vertical position of at least the topmost wheel of each set.

6. A machine as recited in claim 1 wherein each of said wing cutters comprises a toothed cutting drum, and a pair of cutting chains, one chain disposed above and one chain disposed below said drum, and wherein each of said shields extends vertically the length of said drum.

7. A machine as recited in claim 6 wherein each of said cutting drums is rotatable about a drum axis, and wherein each drum axis is pivotal about a parallel axis associated with said body member, and wherein said drum axis and said parallel axis and the termination of said shield associated with each drum are substantially coplanar.

8. A machine as recited in claim 1 wherein said conveying means comprises an auger having a central shaft, and wherein said auger comprises a plurality of auger sections connected together, each of said auger sections including a non-rotatatve stabilizing assembly and a power source conduit.

9. A mining machine for cutting an in-bore and an out-bore larger than said in-bore during in-cutting and out-cutting respectively, comprising (a) a non-rotatable body member, with stabilizing means for insuring non-rotativw movement of said body member in a bore, (b) a rotatable pilot cutting head, mounted in front of said body member, and means for rotating said pilot cutting head for cutting a generally circular in cross-section bore, (c) a pair of wing-cutters pivotally mounted to said non-rotatable body member behind said pilot head in non-interfering relationship with said pilot head, (d) conveying means mounted behind said wing-cutters in operative association with said body member, for conveying coal or the like cut by said pilot head and said wing-cutters away from the cutting site, (e) means for pivotally moving said wing-cutters with respect to said non-rotatable body member from a first position, wherein said wing-cutters are in general alignment with said pilot cutting head and body member, during in-cutting, to a second position wherein each of said wing-cutters extends outwardly with respect to said pilot cutting head, during out-cutting, (f) means maintaining said wing-cutters in said second positions thereof during out-cutting thereby, (g) cutting means for cutting the roof of the bore formed by said machine, said cutting means including a cutting drum rotatable about a generally horizontal axis and a pair of cutters, one mounted at each end of said drum, (h) means for rotating said cutting drum about said generally horizontal axis, said means for rotating including a mounting for a horizontal shaft, which mounting is stationary with respect to said body member, and a pair of chain cutters each disposed between a gear end end of said cutting drum and a gear mounted at an end of said horizontal shaft associated with said stationary mounting, said cutters located exteriorly of said drum gear ends, and (i) means for moving said cutters horizontally with respect to said mounting and said body member so that roof cutting can be effected during outcutting to produce a wider roof cut than during in-cutting.

10. A machine as recited in claim 9 further comprising means for mounting said cutting drum axis for pivotal movement with respect to said horizontal shaft mounting and said body member to adjust the vertical position of said cutting drum, and power means for pivotally moving said cutting drum axis.

11. A machine as recited in claim 10 wherein said means for moving said cutters horizontally with respect to said mounting and said body member comprise a dual piston-cylinder assembly, the pistons mounting said cutter, and the cylinders disposed within said cutting drum.

12. A machine as recited in claim 9 wherein said means for moving said cutters horizontally with respect to said mounting and said body member comprise a dual piston-cylinder assembly, the pistons mounting said cutters, and the cylinders disposed within said cutting drum.

13. A mining machine for cutting an in-bore and an out-bore larger than said in-bore during in-cutting and out-cutting respectively, comprising (a) a non-rotatable body member, with stabilizing means for insuring non-rotative movement of said body member in a bore, (b) a rotatable pilot cutting head, mounted in front of said body member, and means for rotating said pilot cutting head for cutting a generaly circular in cross-section bore, said rotating means including a rotatable shaft, (c) a pair of wing-cutters pivotally mounted to said non-rotatable body member behind said pilot head in non-interfering relationship with said pilot head, (d) conveying means mounted behind said wing-cutters in operative association with said body member, for conveying coal or the like cut by said pilot head and said wing-cutters away from the cutting site, said conveying means comprising (i) a double helix distributor member mounted on said shaft for rotation of said pilot cutting head for agitating and distributing cut coal or the like, said double helix distributor being disposed posterior of said wing-cutters, (ii) scoop means disposed posterior of said distributor member and having a bottom portion substantially abutting the bore floor and then extending posteriorly therefrom at a positive angle, and having side members that funnel toward said shaft, and (iii) a conveyor belt disposed posterior of said scoop means, said scoop means bottom portion and side members funnelling toward said conveyor belt, and a top, transporting surface of said conveyor belt being disposed adjacent the termination of said scoop means bottom portion and side members, said shaft being vertically spaced from the conveyor top conveying portion in non-interfering relationship therewith, (e) means for pivotally moving said wing-cutters with respect to said non-rotatable body member from a first position, wherein said wing-cutters are in general alignment with said pilot cutting head and body member, during in-cutting, to a second position wherein each of said wing-cutters extends outwardly with respect to said pilot cutting head, during out-cutting and (f) means maintaining said wing-cutters in said second positions thereof during out-cutting thereby.

14. A machine as recited in claim 13 further comprising an auger section on said shaft for rotation of said pilot head, and located posterior of said distributor and having continuously decreasing flight diameter from said double helix disposed above said scoop means bottom portion for conveying cut coal or the like up said bottom portion, said auger section termination before said conveyor belt.

15. A machine as recited in claim 13 wherein said conveyor belt includes an anterior portion adjacent said scoop means comprising a plurality of rollers supporting said conveyor belt.

16. A machine as recited in claim 15 wherein said conveyor belt includes portions posterior of said anterior portion comprising rollers forming a trough and supporting said conveyor belt conveyor surface.

17. A machine as recited in claim 15 wherein each of said rollers comprises a solid metal core portion with a resilient material coating.

18. A machine as recited in claim 13 wherein said conveyor belt comprises a plurality of rollers forming a trough and supporting said conveyor belt conveying surface.

19. A machine as recited in claim 18 further comprising a plurality of add-on sections for said shaft and said conveyor belt, said add-on sections each comprising vertically extending supports for supporting said trough-forming rollers, stabilizing means for engaging the formed bore, and a housing collar supported by said vertically extending supports for mounting said shaft.

20. A machine as recited in claim 13 wherein said scoop belt bottom portion is disposed at an angle of less than about 14° with respect to the bore floor.

21. A machine as recited in claim 20 wherein said scoop means bottom portion angle is about 12°.

* * * * *